United States Patent [19]

Harima et al.

[11] 4,015,021

[45] Mar. 29, 1977

[54] METHOD FOR PRODUCING INDIVIDUALLY WRAPPED FOODSTUFF SLICES

[76] Inventors: Eiichi Harima, c/o Miyamoto-so, No. 734, Takahata, Hiraoka-cho, Kakogawa, Hyogo; Yosiro Okubo, No. 14-12, Akabane-kita, 3-chome, Kita, Tokyo, both of Japan

[22] Filed: May 13, 1975

[21] Appl. No.: 577,052

Related U.S. Application Data

[63] Continuation of Ser. No. 312,691, Dec. 6, 1972, abandoned.

[52] U.S. Cl. ..... 426/393; 53/21 R; 53/23; 53/25; 53/28; 426/130; 426/413; 426/414

[51] Int. Cl.[2] ..... B65B 25/06; B65B 9/00

[58] Field of Search ..... 426/413, 414, 130, 410, 426/393, 129, 108, 512, 515, 516; 53/25, 122, 124 A, 180 R, 180 M; 426/512, 515, 516

[56] References Cited

UNITED STATES PATENTS

| | | | |
|---|---|---|---|
| 2,134,862 | 11/1938 | Dunnam | 53/124 A |
| 2,505,603 | 4/1950 | Brandenberg | 426/413 |
| 2,613,488 | 10/1952 | Attride | 53/122 X |
| 2,759,308 | 8/1956 | Nawrocki | 53/122 |
| 3,436,927 | 4/1969 | Gruber | 426/524 |
| 3,542,570 | 11/1970 | Bush et al. | 426/414 X |
| 3,544,340 | 12/1970 | Miller et al. | 426/410 |
| 3,598,615 | 8/1971 | Chamberlain | 426/393 |
| 3,623,653 | 11/1971 | Work | 426/130 |
| 3,688,468 | 9/1972 | Erekson | 53/122 |
| 3,851,068 | 11/1974 | Kraft | 426/130 |

*Primary Examiner*—Steven L. Weinstein
*Attorney, Agent, or Firm*—Lane, Aitken, Dunner & Ziems

[57] ABSTRACT

An improved method for producing individually wrapped foodstuff slices. A linked series of the wrapped foodstuff slices is produced by press-molding, to a desired slice form, the foodstuff material which has been preformed to a flat continuous strip encased in a wrapping film. The foodstuff is wrapped so that the edge of the lower layer of the overlapping ends portions of the wrapping film, is aligned with the outermost edge of the foodstuff slice and the upper layer is folded inwardly thereon.

9 Claims, 7 Drawing Figures

METHOD FOR PRODUCING INDIVIDUALLY WRAPPED FOODSTUFF SLICES

This is a continuation of application Ser. No. 312,691, filed Dec. 6, 1972, now abandoned.

BACKGROUND OF THE INVENTION

This invention relates to a method and apparatus for packaging foodstuffs in the form of individually wrapped single slices and the foodstuff so wrapped.

In prior conventional methods for preparing food such as a sandwich in which meat slices such as ham, sausage and cheese are sandwiched between two pieces of bread, the cutting of the foodstuff into slices requires considerable skill or a complicated device and thus is time consuming or costly.

To avoid such problems, there has been proposed a method wherein several pieces of sliced foodstuff are laid on top of the other each individually wrapped with a plastic film. However, this method is not a complete solution to the problem, because once the wrapping film is broken, if some of the sliced food is left unused for a given period of time, then the remaining sliced food is likely to dry-solidify or deteriorate in quality, or, in the case of cheese, the slices become adhered to each other, broken or deformed.

Another method has been proposed which produces individually wrapped slices by extrusion of the foodstuff, into a wrapping film. However, this method has met with only partial success, because the opening of the nozzle, through which the food material is extruded, is a flat or narrow slit and, as a result, food materials of high viscosity tend to plug the nozzle. Also, conversion to a different thickness for the food slice requires replacement of the nozzle at the sacrifice of consuming considerable time. In addition, controlling of the weight of the individual slice is difficult with such equipment.

Another problem encountered in wrapping individual food slices is that when many slices are stacked, one on top of the other, breakage or cracking of the slices often occurs due to the bulges produced by overlapping end portions of the heat-sealed wrapping film. Bending of the slices when unwrapping also produces breakage. This is principally because the end portions of the wrapping film overlap near the center of each individual slice.

Accordingly, it is an object of the invention to provide a method and apparatus for wrapping foodstuffs as individual slices which method and apparatus do not require a complicated slicing device or the use of a nozzle having a narrow flat opening, and thereby avoid binding of the food material within the nozzle.

It is another object of the invention to provide a method and apparatus for wrapping foodstuffs in slice form, which method and apparatus provide an easy means to produce such a slice-form foodstuff in various thicknesses without replacing the nozzle.

It is still a further object of the invention to provide wrapped foodstuffs in slice form which are unlikely to break or crack when stacked or unwrapped.

SUMMARY OF THE INVENTION

An improved method and apparatus are provided for producing foodstuffs in the form of individually wrapped single slices (such as cheese). The starting material or foodstuff, which is plastic and hence extrudable, is first extruded through an annular nozzle having a circular opening of a substantial size into an envelope or tube of wrapping film. The material thus extruded is then formed to a flat strip by means of a pair of press-rolls. The flat strip thus formed is then fed between opposing molding frames each mounted on a pair of moving endless belts located in parallel and is thereby press-molded into single slice form, leaving longitudinally spaced intervals between each "slice." The space intervals are formed by squeezing the extruded strip between vertically projecting wall portions of the molding frames. The vertically projecting mold walls are designed to come into intimate contact as the frames pass along the inner runs of the belts to pinch the strip to form the "slices." Each slice is further molded to the required thickness and size by means of press-plates individually housed in each molding frame of the upper belt pair. The press-plates are mounted in movable relationship with the sidewalls of the frames. The strip of connected wrapped "slices" is then transferred to a cooling means and heat-cut at the film portions between the slices. In feeding wrapping film to enclose the extruded food material, the edge of the lower layer of the lap joint portion of the film is arranged to align with an outer edge of the flattened foodstuff strip and then the upper layer is folded inwardly thereon. This avoids direct contact between the edge of the lower film layer and the surfaces of the foodstuff strip itself, and thereby avoids the formation of a "notch" in the surface of the foodstuff strip.

DETAILED DESCRIPTION OF PREFERRED EMBODIMENTS

Figure 1:
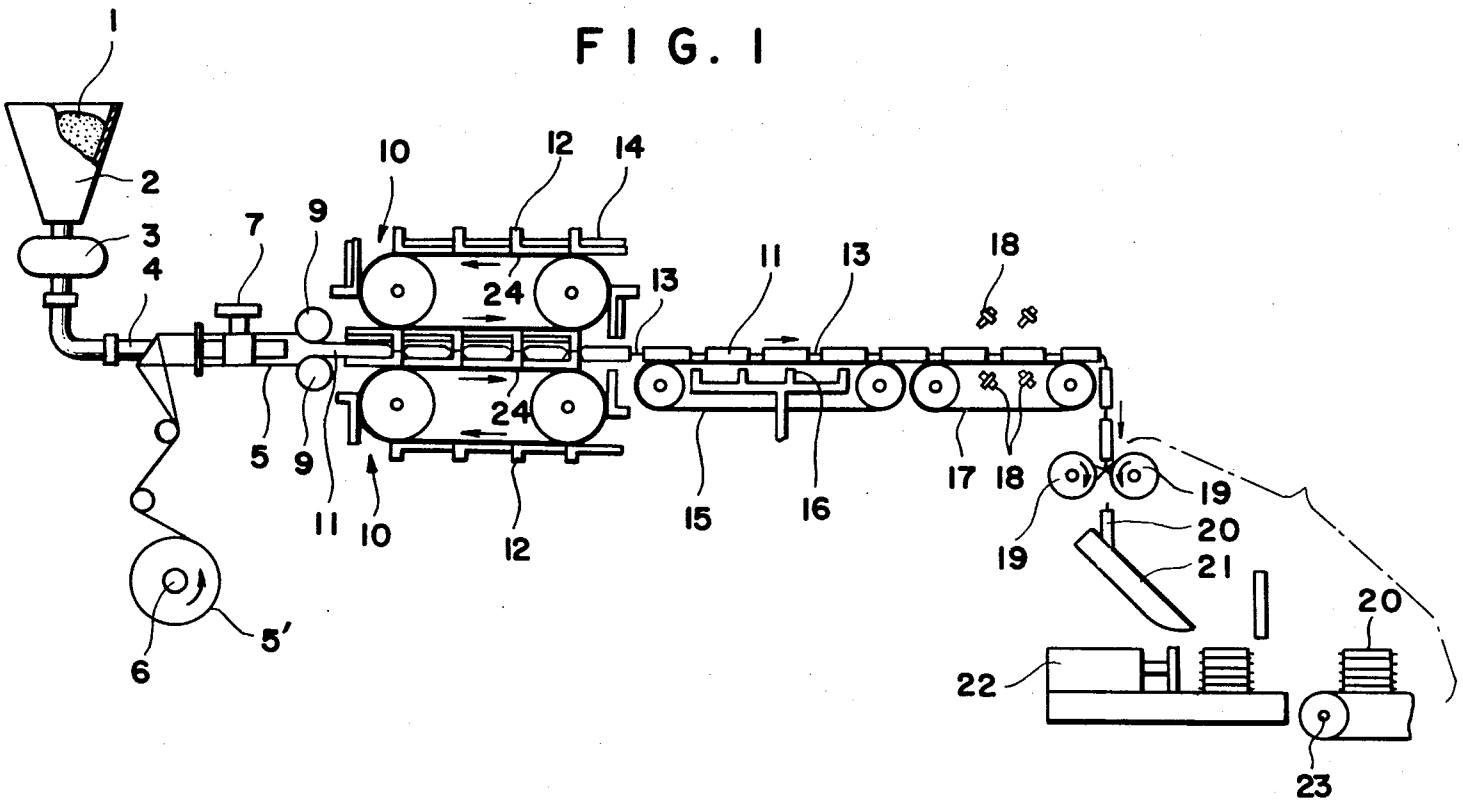
FIG. 1 is a schematic view of the apparatus of the present invention, showing the side elevation thereof.
Figure 3:
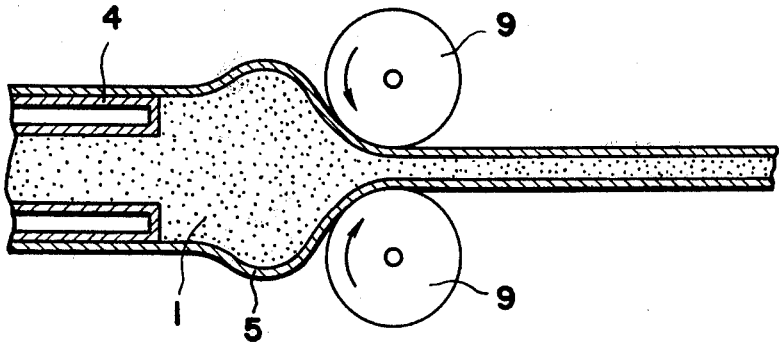
FIG. 3 is a partially fragmented longitudinal cross-sectional view of the double-walled nozzle and pair of press rolls.
Figure 4:
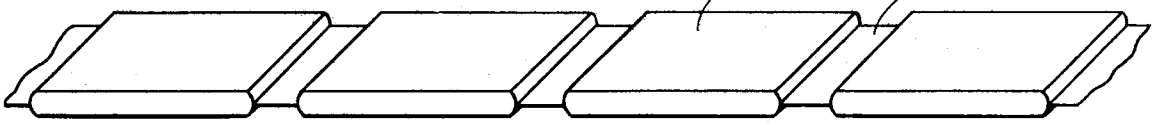
FIG. 4 is a perspective view of a strip of a plurality of individually wrapped foodstuff slices.

Referring to FIG. 1, the foodstuff 1, which is fluid or semi-fluid, such as for example processed cheese or cheese foods, is placed into a hopper 2 and continuously fed to a nozzle 4 by means of a pump 3. The nozzle 4 is formed with a double wall construction, as shown in FIG. 3, which permits temperature control. The opening of the nozzle 4, including the contour thereof, is circular in shape.

Figure 5:
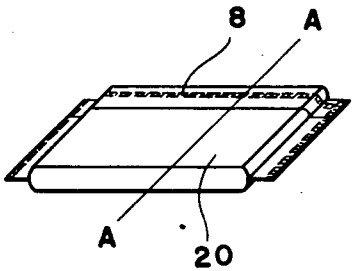
FIG. 5 is a perspective view of a single slice of the foodstuff.

The nozzle 4 is inserted into a tube of wrapping film 5 which has been formed from a strip 5′ of the film. The film holder 6 and sealer 7 can be adjusted so that the seam portion 8, shown in FIGS. 5 and 6, may be located at the desired position, for example, offset toward the outermost edge of the wrapped slice. This feature aids in preventing the slice from breaking or cracking when the wrapping film is opened or when the wrapped slices are stacked. If the overlap between the end portions of the film is located near the center of the slice, then the slice would tend to break due to bending when unwrapped, and would also tend to break when stacked on top of the other due to the "hump" or raised surface at the overlap. Accordingly, the overlapping portion of the film should preferably be located as close to the outermost edge of the wrapped slice as possible.

The sealing of the film should be such that only a minimum amount of force is required to open the package or wrapping of the individual slice.

The tubular film 5 filled with the food material 1 is then fed between press rolls 9 for pressing into strip form in which the food material therein is in intimate contact with the inner surface of the film. The spacing between the two rolls 9 can be adjusted together with the pressure of the molding device 10, so that the weight and thickness for the individual slices can be regulated. In addition, the temperature at the roll surfaces is also controllable. The roll means 9 serves not only to reduce the material to strip form but also to transport the strip thus formed.

The food material strip 11, after leaving the rolls 9 is then press-molded to the desired shape by means of a molding device 10. The molding device 10 comprises a plurality of molding frames 12, ten mounted on each pair of moving belts 24. The inner runs of belts 24 are arranged in opposing relation to each other, so that each molding frame pair comes into matching contact between the inner runs of the belts. These molding frames each have a projecting wall portion 25 rising from the base of the frame, that projects vertically when the frame is moving horizontally between the inner runs of the belts so that the outermost ends of the projecting wall portions 25 come into matching contact to press the strip 11 to form the connecting sections 13 between the single "slices" by squeezing the foodstuff out of those connecting film strip sections.

Figure 2:
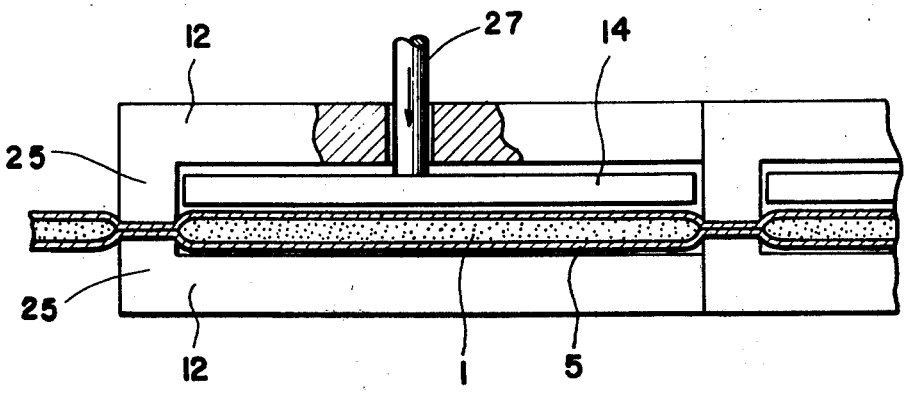
FIG. 2 is a partially fragmented longitudinal cross-sectional view of the press-mold and the press-plate housed therein.

Referring to FIG. 2, a press plate 14 is housed in each of the molding frames 12 mounted on the upper belt 24. Each press plate 14 has a stem 27 extending through an aperature in the molding frame. The stem 27 passes through the mold frame opening or aperture and extends between the parallel pair of upper belts so that it is engaged by camming means located between the upper endless belt pulleys. The press plate 14 is designed to move along the side walls of the molding frame 12 and to be engaged by a camming means (not shown) so as to be pressed against the top surface of the food material strip. This operation enables the formation of foodstuff in slice form having uniform thickness and an exact shape, e.g., an accurate square configuration. The weight and the thickness of a single slice is governed by the spacing of the rolls 9 and by the molding frame 12. The squeezing means, or rolls 9, is functionally independent of the press-molding means 14 so that the travel of the press-plate 14 along the side walls of the frame 12 can freely be adjusted.

The strip of wrapped single slices interconnected to each other is transferred from the press-molding device 10 onto a net type conveyor 15 for cooling, where cool water at a temperature from 0° to 5° C. is jetted from nozzle 16 against the underside of the wrapped slices. The cooling temperature and time duration thereof are selected in accordance with the type of foodstuff being processed. Alternatively, any other conventional type of cooling means may be used. However, the preferred cooling means avoids immersion of the wrapped food material in water and thus avoids the danger of water permeating through the seal of the plastic wrap into the interior of the package. The preferred cooling means also minimizes the drying time required.

Preferably, the speed of travel of the wrapped food strip 11 should be different from the speed of conveyor 15 so that the pattern of the net will not be formed on the surface of the foodstuff slices, which pattern might otherwise spoil the appearance thereof. The foodstuff thus cooled is then introduced into the drying conveyor 17, where the water droplets on the surface of the wrapped foodstuff are removed by air blown from above and below by the air jet nozzles 18, at a pressure of from 5 to 7 kg/cm$^2$.

In a subsequent step, the interconnecting film portions 13 are heat-cut by means of a rotary heat cutter 19 heated to a temperature above melting point of the synthetic resin film 5. The cut edge of the film provides complete sealing without a so-called ear portion, i.e., without the remaining free edges of the overlapped and sealing portion of the film which do not adhere to each other. For sealing the interconnected portion 13, any other type of conventional heat sealing device may be used. Likewise, other conventional cutting devices may be used. Alternatively, the heating means may be mounted on the molding frames 12 so that the sealing operation may be accomplished simultaneously with the press-molding.

The individually cut, wrapped foodstuff single slices 20 are fed into a chute 21 one after another and stacked in a pile, followed by transfer means of a pusher 22 onto a delivery conveyor 23.

As is apparent from the foregoing description, the method and apparatus of the present invention do not utilize a nozzle having a narrow slit opening, and thereby avoid plugging by the food material within the nozzle. Instead, the present invention utilizes a combination of a nozzle having a round opening and press-rolls to thereby control the weight and thickness of the single slices.

Furthermore, the apparatus of the present invention does not incorporate any complicated conventional slicing means and further does not require replacement of the nozzle to effect a change in thickness of the foodstuff slices; instead, to change thickness, it is only necessary to adjust the spacing between the two opposing rolls.

Figure 6:
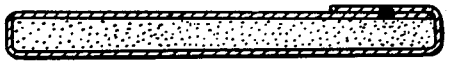
FIG. 6 is a cross-sectional view of a wrapped single slice, taken along the line A—A of FIG. 5.
Figure 7:
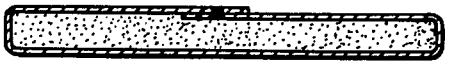
FIG. 7 PRIOR ART
FIG. 7 is a cross-sectional view of a wrapped single slice produced by a prior art system.

The wrapping of foodstuff slices of the present invention has an overlapping portion where the edge of the lower layer of wrapping is aligned with the outer edge of the wrapped foodstuff slice with the upper layer folded inwardly thereon (FIG. 6). This avoids the direct contact of the edge of the lower layer of the film with the surface of the foodstuff itself, thereby precluding the formation of a "notch" on the surface of the food slice as shown in FIG. 7. The presence of a "notch" would otherwise tend to result in breaking the food slice during unwrapping. This design also avoids breakage or cracking of the products when many of them are stacked one on top of the other.

It will be readily observed from the foregoing detailed description of the invention and from the illustrated embodiments thereof that numerous variations and modifications may be effected without departing from the true spirit or scope of the novel concepts and principles of the present invention.

We claim:

1. A method for producing a wrapped foodstuff in single slice form comprising:

extruding the foodstuff into an envelope or tube of wrapping film to form a wrapped foodstuff;

flattening the wrapped foodstuff into a continuous strip;

applying a first pressing force against said flat strip at spaced intervals to express the wrapped foodstuff from between said wrapping film at said spaced intervals and form enclosed portions of said strip between said spaced intervals to establish individually wrapped press-molded foodstuff slices of a predetermined length;

applying a second pressing force transversely against the strip in each enclosed portion after the first pressing force has been applied and while the first pressing force is retained at spaced intervals to further mold the individually wrapped foodstuff slices to a predetermined thickness;

cooling the wrapped foodstuff slices thus formed;

heat sealing the wrapping film at said spaced intervals; and cutting the wrapping film at said spaced intervals to produce individually wrapped and sealed foodstuff slices.

2. The method of claim 1, wherein said extrudable foodstuff is a cheese product.

3. The method of claim 1, wherein said heat-sealing and cutting is by means of a rotary heat-cutter at a temperature above the melting point of said wrapping film to provide welded seals at the opposite ends of the respective slices.

4. The method of claim 1, wherein the step of heat sealing the wrapping film at said spaced intervals is performed simultaneously with the step of applying a first pressing force against said flat strip.

5. The method of claim 1 wherein said individual slices are molded into an accurate square configuration.

6. The method of claim 5 wherein said tube is formed from a sheet of said film by heat-sealing the longitudinal edges of the sheet to form a seal and wherein said seal of said tube is positioned, prior to extrusion of the foodstuff, so that the seam will be located adjacent one edge of said flat strip.

7. The method of claim 1, wherein said cooling is by means of jets of cooling water at a temperature of from 0° to 5° C while transferring said molded foodstuff slices by means of a conveyor.

8. The method of claim 7, wherein said conveyor is a net-type conveyor and is moved at a different speed from the speed of travel of said molded foodstuff slices.

9. The method of claim 7, additionally comprising removing the cooling water from the surface of the molded foodstuff by air jets at a pressure of from 5 to 7 $kg/cm^2$.

* * * * *